US005645280A

United States Patent [19]

Zelmer

[11] Patent Number: 5,645,280

[45] Date of Patent: Jul. 8, 1997

[54] EDUCATIONAL BOARD GAME FOR AMUSEMENT AND VOCABULARY BUILDING

[76] Inventor: Loren Zelmer, P.O. Box 3391, Santa Cruz, Calif. 95063

[21] Appl. No.: 619,826

[22] Filed: Mar. 15, 1996

Related U.S. Application Data

[63] Continuation-in-part of Ser. No. 407,386, Mar. 17, 1995, abandoned.

[51] Int. Cl.[6] ..... A63F 3/00

[52] U.S. Cl. ..... 273/256; 273/272

[58] Field of Search ..... 273/242, 243, 273/248, 249, 256, 272

[56] References Cited

U.S. PATENT DOCUMENTS

| | | | |
|---|---|---|---|
| 2,026,082 | 12/1935 | Darrow | 273/256 |
| 2,070,608 | 2/1937 | Mitchell | 273/272 |
| 4,055,347 | 10/1977 | Kreischer | 273/272 X |
| 4,501,425 | 2/1985 | Alvarado | 273/256 |
| 4,585,232 | 4/1986 | Sheppard et al. | 273/256 X |
| 4,682,777 | 7/1987 | Wood | 273/256 X |
| 4,889,344 | 12/1989 | Zimba | 273/272 X |
| 5,388,836 | 2/1995 | Foti | 273/256 |

*Primary Examiner*—William E. Stoll

[57] ABSTRACT

A recreational and educational vocabulary-building board game for a minimum of two players which includes a game board having a plurality of sequential spaces with the letters of the alphabet, direction, and vocabulary-related categories thereon; a plurality of cards having word definitions, directions, or vocabulary-related questions and answers thereon and adapted for chance selection of a card one at a time; a plurality of place markers corresponding to each of the players; and a mechanism for determining the number of spaces to be traversed by each place marker in accordance with established game rules.

11 Claims, 3 Drawing Sheets

EDUCATIONAL BOARD GAME FOR AMUSEMENT AND VOCABULARY BUILDING

This is a continuation in part of application Ser. No. 08/407,386, filed Mar. 17, 1995, now abandoned.

BACKGROUND OF THE INVENTION

1. Field of the Invention

This invention relates to board games, and more particularly to a vocabulary-building board game which can be used for both educational and entertainment purposes and which involves correct definitions of given words and answers to vocabulary related questions.

2. Description of the Prior Art

Various board games exist which involve vocabulary words, but few, if any, are both educational and entertaining, and tailor the scope of their vocabulary words and definitions to specific groups or educational levels. The game of the present invention contains interactive structural components and indicia and derives its words and definitions from specific pre-selected sources, to meet specific educational objectives, and presents them and their educational value in an entertaining and creative manner, which involves strategy as well as vocabulary skills.

SUMMARY OF THE INVENTION

The object of the present invention is to provide an entertainin and intellectually challenging word game wherein the players' vocabularies will be increased and wherein readiness for standardized tests, such as the Scholastic Aptitude Test and Graduate Record Examination, will be enhanced.

According to the present invention, a vocabulary game is provided for at least two players and includes a board having a plurality of sequential spaces indicated thereon; a plurality of cards having indicia thereon relating them to predetermined ones of the sequential spaces and having words and their definitions thereon; additional cards carrying directions for play, and vocabulary-related questions and answers printed thereon; the cards being adapted for chance selection of a card one at a time; a plurality of place markers corresponding to each of the players; and means for determining the number of spaces to be traversed by each playing member in the course of play in accordance with the game rules.

In accordance with the invention, in the course of play, each player advances his place marker along the playing path a number of sequential spaces on the perimeter of the board the number being determined by chance means, and a card is chosen or directions are given in accordance with the letter or category indicia within the space on which the player's place marker lands. In further accordance with the invention, the chosen card indicates either a word to be pronounced and defined, a direction for further play, or a category of question to be answered by each player in the course of play. A correct pronunciation and definition of the selected word or a correct answer to the selected question earns the player a word definition card, and players who earn entire sets of word definition cards of particular colors acquire an advantage in winning the game. Acquisition of vocabulary word definition cards representative of all letter spaces on the game board will win the game.

A further object of the present invention is to provide a board game which stimulates the players and allows them to strategize and be creative as well as improve their vocabulary and help to fulfill certain educational objectives.

DETAILED DESCRIPTION OF THE PREFERRED EMBODIMENT

The vocabulary game in accordance with the present invention allows for a player to win by acquiring an entire set of word definition cards based upon his or her ability to pronounce and define the vocabulary words on the cards, to answer the questions on several vocabulary-related question and answer cards, plus an element of chance.

Figure 1:
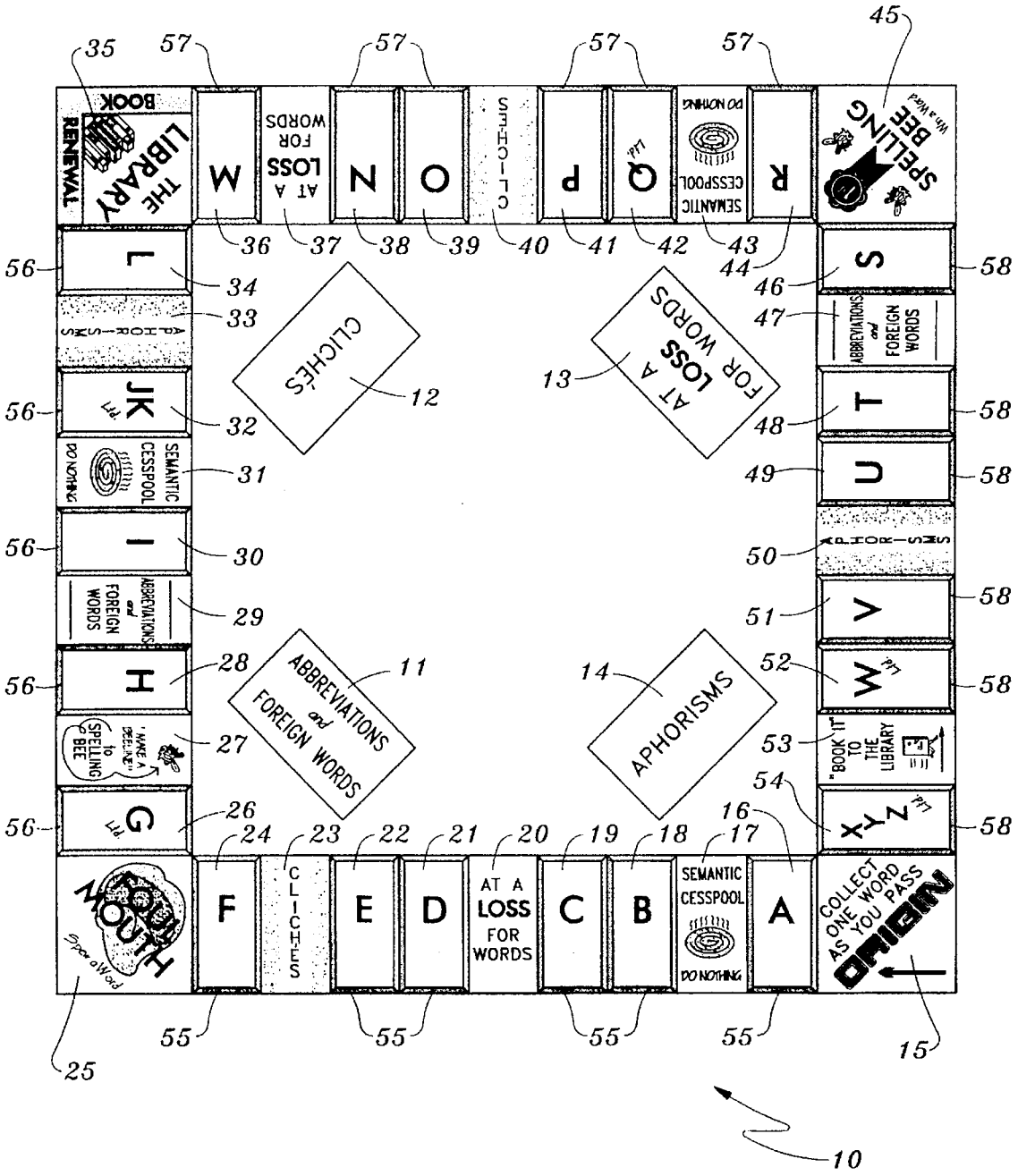
FIG. 1 shows a top view of the game board apparatus.
Figure 2:
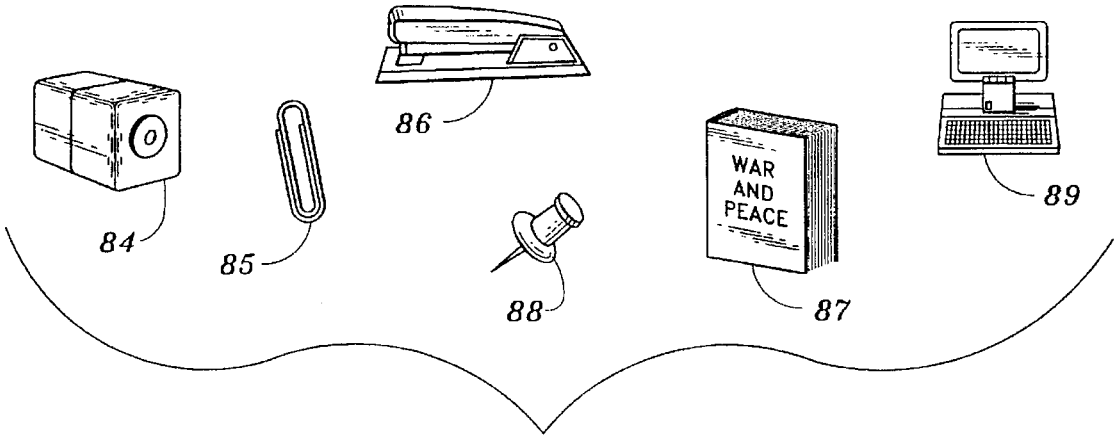
FIG. 2 is a perspective view of a set of 6 place markers of a literary or clerical theme useable in the game of FIG. 1.

This game is suitable for 2 to 6 players. As illustrated in FIG. 1 and FIG. 2, the game equipment includes a game board apparatus 10 and a plurality of place markers 84,85, 86,87,88,89 having shapes relating to a literary or clerical theme.

Figure 3:
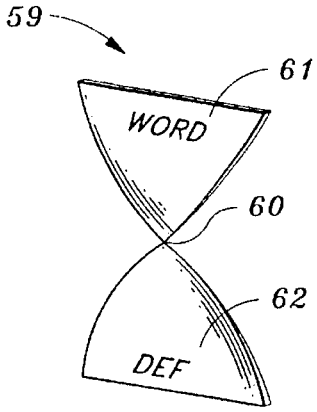
FIG. 3 illustrates a perspective view of a twisted individual word definition or vocabulary word card, selected from one of several color coded categories corresponding to color designations on the game board, displaying one word on one side and a corresponding pronunciation and definition or definitions on the opposite side.

FIG. 3 illustrates a perspective view of a twisted vocabulary word card or definition card 59, with the twisted portion 60 allowing a view of the word category on the front side 61 and the pronunciation and definition on the opposite side 62.

Figure 4:
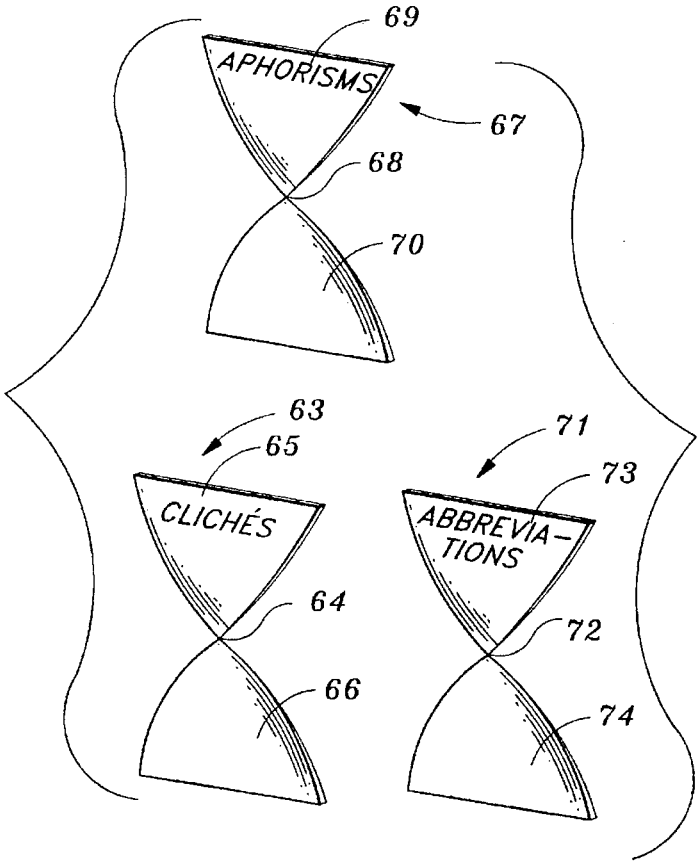
FIG. 4 illustrates a perspective view of a twisted individual vocabulary-related question and answer card displaying a category designation on one side and a question and answer on the opposite side upside down from each other.

FIG. 4 shows perspective views of twisted individual question cards or vocabulary-related question and answer cards 63,67,71, with the twisted portions 64,68,72 allowing views of the vocabulary categories on the front sides 65,69, 73, and the questions and answers on the opposite sides 66,70,74, upside down from each other.

Figure 5:
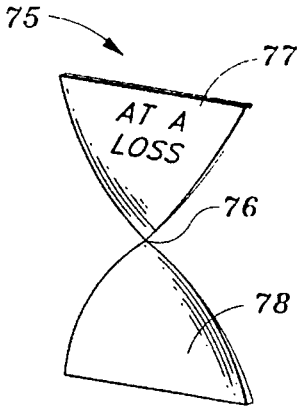
FIG. 5 illustrates a perspective view of a twisted individual direction card displaying a category designation on one side and a direction of play on the other.

FIG. 5 shows a perspective view of a twisted individual direction of play card 75, whose function will be explained herein below, with the twisted portion 76 allowing a view of the category on the front side 77 and a direction of play on the opposite side 78.

Figure 6:
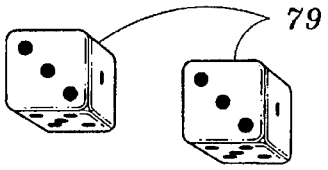
FIG. 6 represents a pair of conventional dice as the preferred embodiment of the chance means of the game of the present invention.

FIG. 6 shows a pair of conventional dice 79 as the preferred embodiment of the chance means.

Figure 7:
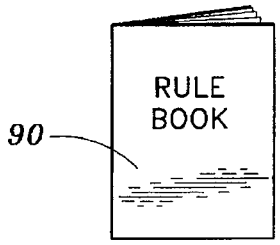
FIG. 7 shows a rule book which serves to control the course of conduct of the game.

FIG. 7 shows a rule book 90 containing instructions for play.

Figure 8:
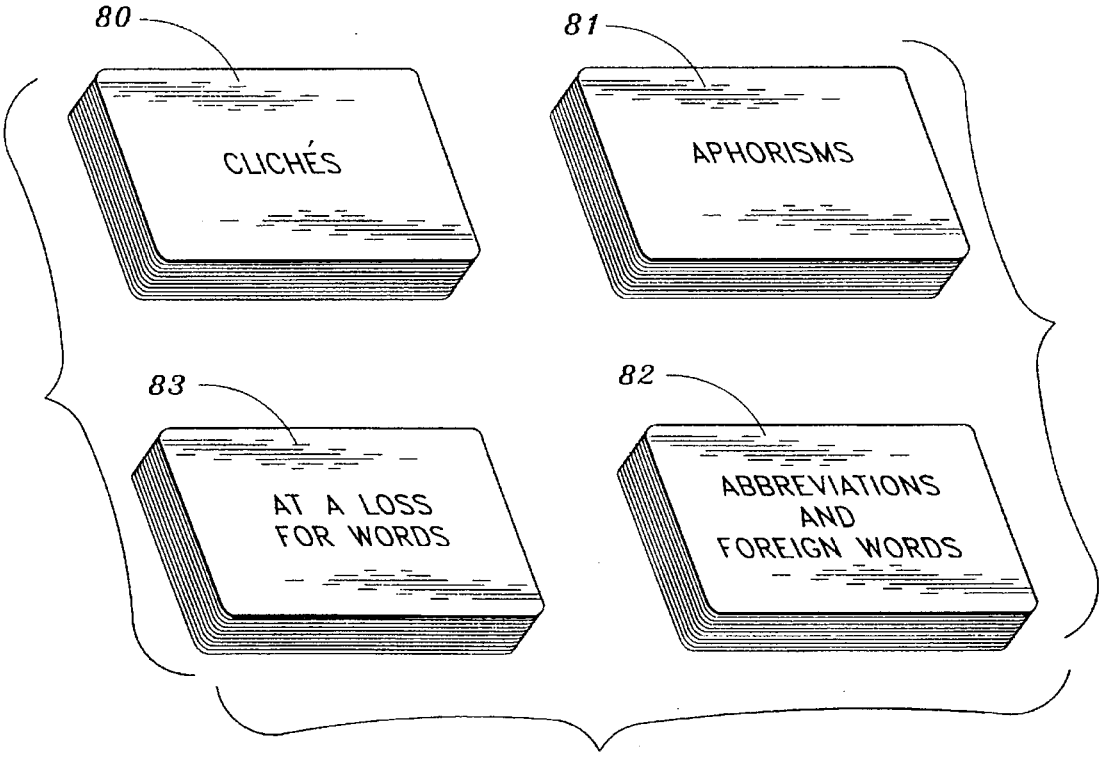
FIG. 8 is a perspective view of the four decks of cards corresponding to the vocabulary-related question and answer cards and the direction cards.

FIG. 8 shows a perspective view of the three decks of cards 80,81,82 corresponding to the vocabulary-related questions and answer cards 63,67,71 and the deck of cards 83 corresponding to the direction of play cards 75.

Figure 9:
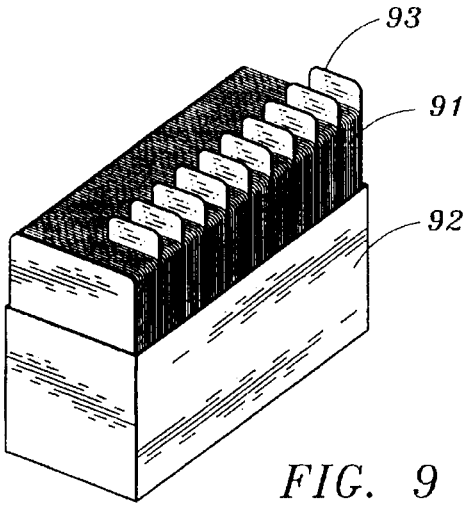
FIG. 9 illustrates a container means holding a deck of word definition cards, separated into categories by dividers.

FIG. 9 shows a perspective view of a deck of cards 91 corresponding to the word definition cards 59, held in a container means 92 and separated into categories by dividers 93.

Figure 10:
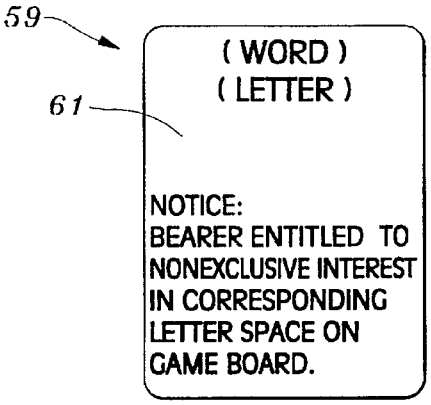
FIG. 10 shows indicia on the vocabulary word card of FIG. 3 establishing a nonexclusive interest in a letter space on the game board of FIG. 1.

FIG. 10 illustrates the functional relationship between the vocabulary word cards 59 and certain ones of the sequential spaces on the game board 10.

The game strategy is based on an abstraction of microeconomic market structure theory. According to this theory, markets are classified into four types from most competitive to least competitive: pure competition, monopolistic competition, oligopoly and monopoly respectively. As a market approaches a less competitive structure (toward a monopoly), the firms within that industry gain more control or power. Likewise, in the game, as the player acquires more interests in the market, he also gains more control over the market and is able to become more of a price maker; i.e., able to exercise greater influence over the price for products or services coming from that (greater) portion of that market in which he has more interests.

Obviously, the competitive aspects of the four market types constitute a continuum. In the initial market type, an industry which exhibits pure competition is an industry into which new firms can move with ease and out of which unsuccessful firms can easily exit. With regard to the game in question, this equates to no penalty incurred for a player who attempts to acquire an interest and is yet unsuccessful. He or she can move on without penalty. In keeping with microeconomic theory, it should be noted that in pure competition no firm or group of firms can substantially affect the market price.

At the other end in the ultimate market type, we have monopoly. A monopoly is where there is a complete barrier to entry into the market. In a monopoly there is only one firm. With regard to the game in question, this equates to the winning player. Once a given player acquires an interest in each of the spaces (letter spaces) in the word market, he or she has in essence obtained a monopoly of the interests in the word market; i.e., a Wordopoly.

The two intermediate cases of market types, monopolistic competition and oligopoly, demonstrate the increased cost of entry into or exit from the market. It also shows us the increasing relative ability, as we move toward monopoly, of firms operating in these conditions to affect price. In monopolistic competition, product differentiation acts as a barrier to entry for firms aspiring to enter the market. Therefore, in monopolistic competition, there is not complete freedom of entry as in pure competition, but only reasonable freedom of entry. The game structure mandates a penalty for those players who do not provide successful response under this condition. In an oligopoly, there are substantial barriers to entry, as indicated by the game structure which exacts an increased penalty for an unsuccessful response relative to the penalty levied for incorrect response in monopolistic competition.

The object of the game is to acquire a nonexclusive interest in each of the letter of the alphabet spaces on the game board 10. The status of each letter of the alphabet space may therefore be seen to assume a pure competition status, a monopolistic competition status, an oligopoly status, and ultimately a Wordopoly status as the game progresses to conclusion.

DESCRIPTION OF PLAY

In reference to FIGS. 1–9, all card decks are shuffled and the four decks 80,81,82,83 of vocabulary-related question and answer cards 63,67,71 and direction of play cards 75 are placed on their designated spaces 11,12,13,14 on the game board. Each player chooses his or her place marker 84,85, 86,87,88,89 and places it on the ORIGIN space 15 to begin the game.

Each player rolls the dice 79 to determine who will begin, with the player rolling the highest number taking the first turn, and the subsequent player rotation going clockwise around the board.

In the order established, each player rolls the dice 79 and moves his or her place marker 84,85,86, 87,88,89 the indicated number of spaces. Those players rolling doubles may take another subsequent turn for a maximum of three in succession. Multiple place markers may occupy one space at the same time.

If a player's place marker lands on a space designated by a letter or letter group 16,18,19,21,22, 24,26,28,30,32,34, 36,38,39,41,42,44,46,48,49,51,52,54, that player must correctly pronounce and define a vocabulary word on a word definition card 59 chosen from a card deck 91 with the appropriate letter designation stored in card holder 92 on an exterior of the game board. An opponent will select a word definition or vocabulary word card 59, bearing the word on one side 61 and the pronunciation and definition on the other 62, from the deck 91 and show the word to the player. The word categories corresponding to letter spaces on the game board 10 are separated in the card holder 92 by the dividers 93. A correct response results in acquisition of that word definition card 59, which the player retains to represent a nonexclusive "interest" in that letter space or word category. The nonexclusive interest is mandated by the "Bearer" legend as seen in FIG. 10 of the drawings.

ARBITRATION. Player-rendered definitions that are approximate to those stated on the word definition cards 59 must be agreed upon as accurate by a majority of the players in order to be deemed acceptable. Exact definitions need not be subjected to arbitration. Disputes can also be settled by dictionary sources.

SPECIFICS OF WORD CATEGORY PLAY. The degree to which a player is credited or debited for a correct or incorrect response depends upon the "concentration of power" or the amount of interest owned by the respective players in the respective word categories. The scheme employed is adopted from microeconomic market structure theory. Obtaining "interest" in a word category, which indicates a nonexclusive interest in a letter space on the board 10, is represented by acquisition of a word definition card 59 corresponding to the letter space.

Said card and the corresponding nonexclusive interest in a letter space is acquired by correctly pronouncing and defining a word on a card 59 selected when a player's place marker 84,85,86,87,88,89 lands on a space designated by a letter or letters 16,18,19,21,22, 24,26,28,30,32,34,36,38,39, 41,42,44,46,48,49,51,52,54. The selected card 59 carries indicia prolcaiming that it represents a nonexclusive interest in the corresponding letter space on the game board 10.

PERFECT COMPETITION. This is a condition where no one player has yet gained an "interest" in the word category in question. Any player whose place marker 84,85,86,87,88,89 lands on a space which requires selection of a vocabulary word category card 59 from the card holder 92 and who provides a correst response will obtain an "interest" in that word category and a corresponding letter space on the board 10 as indicated on the card 59. There is no penalty for an incorrect response, and the card is replaced at the back of the corresponding section denoted by a divider 93 within the card deck 91.

MONOPOLISTIC COMPETITION. This is a condition where at least one player has an "interest" in the word category and corresponding letter space in question, but no one player has "interest" in all of the word categories in the corresponding color group 55,56,57,58 shown on each of the four sides of the board 10 as seen in FIG. 1. Any player whose place marker 84,85,86,87,88,89 lands on a such a letter space and who provides a correct response will obtain an "interest" in the word category and letter space in question. For an incorrect response, the player must remit one word definition card 59 to each opposing player that has "interest" in the letter space and word category.

OLIGOPOLY. This is a condition where at least one player has "interest" in all of the word categories of a given color group 55,56,57,58 shown on each of the four sides of the board 10. Any other player whose place marker 84,85, 86,87,88,89 lands on a space within this color group will obtain "interest" in the corresponding word category and letter space for a correct response. For an incorrect response, the player must remit two word definition cards 59 to each player with an oligopoly that encompasses the word category and letter space in question. It should be understood that while the preferred embodiment of FIG. 1 shows only one color designation within each color group 55,56,57,58, each such group may be divided into smaller distinct color groups on each side of the board 10 while still remaining within the scope of this invention.

MONOPOLY. This condition, where a player obtains "interest" in all word categories and therefore in all letter spaces and color groups 55,56,57,58, shown on each of the four sides of the board 10, signals the end of the game. This player has acquired a monopoly of all word categories, i.e., Wordopoly, and thus wins the game.

SPECIFICS OF NON-WORD CATEGORY PLAY:

CLICHES/APHORISMS. When a player's place marker 84,85,86,87,88,89 lands on a space with one of these designations 23,33,40,50, an opponent picks a card 63,67 from the top of the appropriate deck 80,81 on the game board 10. The opponent then reads to the player the partial phrase stated on the card 63,67 and the player must provide the missing word(s) to complete the phrase. If successful, the player collects one word definition card 59 of his or her choice and a nonexclusive interest in the corresponding letter space on the game board 10 as signified by indicia on the vocabulary word card 59. There is no penalty for incorrect responses.

ABBREVIATIONS AND FOREIGN WORDS. When a player's place marker 84,85,86,87,88, 89 lands on a space with this designation 29,47, an opponent picks a card 71 from the top of the appropriate deck 82 on the game board 10 and reads to the player an abbreviation or word of foreign origin and the player must provide the English meaning or translation. A correct response will earn the player a word definition card 59 representative of a nonexclusive interest in a corresponding letter space on the board 10 and therefore in a word category of his or her choice, and there is no penalty for incorrect responses.

AT A LOSS FOR WORDS. When a player's place marker 84,85,86,87,88,89 lands on a space with this designation 20,37, he or she picks a card 75 from the top of the appropriate deck 83 on the game board 10 and follows the instructions on the card. If the card instructs the player to return a word definition card 59 from a word category in which he or she has no "interest", he or she disregards the instruction.

THE OTHER SPACES:

ORIGIN. In addition to being the starting point of the game, passing or landing on this space 15 by a player's place marker 84,85,86,87,88,89 entitles him or her to collect one word definition card 59 and therefore a corresponding nonexclusive interest in a letter space on the board 10 of his or her choice.

LIBRARY. A player whose place marker 84,85,86,87,88,89 lands on this space 35 by a roll of the dice 79 is considered to be in BOOK RENEWAL and may proceed in regular play on his or her next turn. If a player is instructed to go to this space by landing on the BOOK IT TO THE LIBRARY space 53 or by instruction on an AT A LOSS FOR WORDS card 75, he or she must remain on that space and "study" until he or she rolls the dice 79 on three regular turns or rolls doubles.

FOUL MOUTH. When a player lands on this space 25, by a roll of the dice 79 or by instruction on an AT A LOSS FOR WORDS card 75, he or she must return one word definition card 59 of his or her choice.

SEMANTIC CESSPOOL. A player landing on a space with this designation 17,31,43 does nothing and, after wasting time on semantics, continues in regular play on his or her next turn.

SPELLING BEE. When a player lands on this space 45 by a roll of the dice 79 or "buzzes" over to it after landing on the MAKE A BEELINE TO THE SPELLING BEE space 27, he or she is entitled to collect a word definition card 59 and therefore, as indicated on the card, a nonexclusive interest in a corresponding letter space on the board 10 of his or her choice.

MISCELLANEOUS:

"GANG BUSTER" ANTI-TRUST VIOLATION LAW. Players may trade word definition cards 59 amongst themselves on a one-to-one basis, but no player may acquire in trade the definition card needed to achieve Wordopoly and win the game. Such a "sacrifice of word resources" by a contributing player or players is considered to be an "unacceptable merger".

SCARCITY OF SOME WORD RESOURCES. The careful design of the present invention primarily includes words targeted for specific educational objectives. Therefore, some word categories will contain few words. Spaces exhibiting the "Ltd." designation 26,32,42,52,54 reflect the limited word capacity of these categories. For that reason, each player may collect only one word definition card 59 from any of these categories.

SOCIAL SAFETY NET. Any player who possesses no word definition cards 59 and who finds him or herself required to return such a card because of instruction from an AT A LOSS FOR WORDS card 75, landing on the FOUL MOUTH space 25, or by landing on a space in which another player has interest and giving an incorrect pronunciation and/or definition of the chosen word, is considered to be "temporarily verbally bankrupt" and is entitled to continue play without obligation to "pay".

ALTERNATIVE RULES OF PLAY

SETUP: Same as in the original version above.

THE RULES: All rules are the same as in the original version with the exception of no penalties incurred for incorrect responses in word category play.

I claim:

1. A vocabulary board game for two to six players, the players playing in successive player turns, comprising:

a rectangular game board having four corner spaces and four sides, each of said four sides having at least one distinct characteristic color as well as a plurality of sequential spaces which feature different letters of the alphabet and other spaces which feature indicia which direct a player's actions in accordance with a set of game rules;

a set of vocabulary word cards having indicia thereon including a letter of the alphabet corresponding to a letter space appearing in ones of said sequential spaces which feature different letters of the alphabet, as well as a word from specific sources pre-selected to meet certain educational objectives and pronunciation and definition of said word, and further including indicia proclaiming acquisition of a nonexclusive interest in the corresponding letter space on said game board by a player correctly pronouncing and defining said word, said vocabulary word cards being adapted for chance selection of a card one at a time;

a set of question cards having vocabulary-related questions and answers appearing thereon and adapted for chance selection of a card one at a time;

acquisition by choice of a nonexclusive interest in one of said plurality of sequential spaces which feature letters of the alphabet being obtained by any player correctly responding to the vocabulary related question on one of said set of question cards;

a set of instruction cards for dictating play in accordance with instructions appearing thereon and adapted for chance selection of a card one at a time;

a plurality of space markers, one of said plurality of place markers being assigned to each player;

chance means for indicating a number of said plurality of sequential spaces a player must move said assigned place marker along said four sides of said game board during a particular player turn; and said plurality of sequential spaces providing positions on said game board on which one of said plurality of place markers lands, said plurality of sequential spaces being traversed one at a time in the course of play, and indicating one of said sets of cards from which a card must be selected and instructions for play which do not require card selection.

2. The game of claim 1 wherein there are 6–10 player spaces constituting a set of spaces between each adjacent pair of said four corner spaces, with said plurality of sequential spaces which feature letters of the alphabet within each set of spaces bearing one specific color designation, the acquisition of said letter spaces beating one specific color designation through actual play of the game procuring for a player a distinct advantage in playing and winning the game.

3. A vocabulary board game for two to six players obliged to play in successive player turns, comprising:

a game board having four corner spaces and four sides, each of said sides having at least one different and distinct characteristic color, as well as a plurality of peripheral sequential spaces marked thereon so as to form a playing path, said sequential spaces featuring alternatively letters of the alphabet in predetermined groups of spaces, indicia for directing a player to sources of vocabulary related questions and procedural instructions within the game for continuing play of the game, and for providing direct instructions from the game board for a player's actions in accordance with a set of game rules;

a plurality of place markers for traversing said plurality of sequential spaces, one at a time, one of said place markers being assigned to each player;

a set of vocabulary word cards each having printed matter appearing thereon including a letter of the alphabet corresponding to a letter on one of said sequential spaces featuring letters of the alphabet, as well as a word, its pronunciation and its definition, said word being related to specific sources preselected to meet certain educational objectives, said vocabulary word cards being adapted for chance selection by a player of a card one at a time whenever the player's place marker lands on a corresponding one of said sequential spaces featuring letters of the alphabet each of said vocabulary word cards further carrying indicia proclaiming a nonexclusive interest in said sequential space corresponding to said letter of the alphabet in any player acquiring said card;

a set of question cards having vocabulary related questions and answers printed thereon and being adapted for chance selection by a player of a card one at a time whenever the player's place marker lands on a corresponding one of said sequential spaces featuring indicia for directing a player to vocabulary related questions within the game;

in accordance with said indicia proclaiming a nonexclusive interest, a correct response by a player to printed matter on ones of said set of vocabulary word cards corresponding to one of said sequential spaces featuring letters of the alphabet and on said question cards results in acquisition of a nonexclusive interest in one of said sequential spaces featuring letters of the alphabet, whereby an interest in ones of said sequential spaces featuring letters of the alphabet is obtainable by one or more players, and an incorrect response by the player to printed matter on one of said set of vocabulary word cards elicits no penalty when no other player holds an interest in said sequential space featuring a corresponding letter of the alphabet, and a penalty of transfer of more than one word definition card to each of one or more opposing players holding an interest in all spaces in said predetermined group of spaces which includes said sequential space featuring a corresponding letter of the alphabet;

a set of instruction cards having directions for play in accordance with game rules appearing thereon and adapted for chance selection by a player of a card one at a time whenever the player's place marker lands on a corresponding one of said sequential spaces featuring indicia for directing a player to procedural instructions within the game; and manually operated chance means for indicating the number of said plurality of peripheral spaces a player must move said assigned place marker along the playing path during a particular player turn.

4. The game of claim 3 wherein there are 6–10 peripheral sequential sets of spaces between each adjacent pair of said four corner spaces, with the predetermined groups of letter spaces within each of said peripheral sequential sets bearing one specific color designation, the acquisition of a nonexclusive interest in each letter space within a predetermined group having a specific color designation, through actual play of the game, procuring for a player a distinct advantage in playing and winning the game.

5. The game of claim 3 wherein there are 6–10 peripheral sequential sets of spaces between each adjacent pair of said four corner spaces, with the spaces within each of said sets bearing at least one letter of the alphabet, indicia of a vocabulary-related category, and indicia of a direction for play category, so that there are a total of 24–40 peripheral spaces between the four corners of the board having marked thereon the 26 letters of the alphabet and a plurality of vocabulary-related and direction for play indicia.

6. The game of claim 3 wherein one of said 4 corner spaces is designated as the starting point of play, and said remaining corner spaces bear indicia and instructions for directing the players' actions in accordance with said set of game rules.

7. The game of claim 3 further including indicia for positioning a plurality of sets of said question cards and said instruction cards on an interior space of said game bard.

8. The game of claim 3 further including holding means for containing and storing sets of said vocabulary word cards on an exterior of said game board.

9. A method of providing educational advance for from two to six players, wherein a game is played on a game board having a closed path thereon described by a series of sequential spaces along which player markers are advanced in a common direction, wherein each space has alternatively printed thereon at least one letter of the alphabet, indicia assigning a randomly selected vocabulary related question, indicia assigning a randomly selected instruction for play, or indicia providing direct instructions for play, and wherein a set of vocabulary word cards is provided having a vocabulary word and the word pronunciation and definition printed thereon as well as indicia proclaiming a nonexclusive interest in a corresponding letter of the alphabet space in the bearer of the vocabulary word card;

a set of question cards having vocabulary related questions and answers printed thereon, and a set of instruction for play cards having mandatory playing instruction printed thereon, the educational advance involving exposure to a predetermined group of vocabulary words, vocabulary related questions and instructions for play, comprising the steps of assigning each player a player marker, assigning each player a playing turn in rotation, determining by chance for each player in turn the number of spaces the player must advance the assigned player marker, drawing at random a vocabulary word card from the set of such cards when a player's assigned marker is advanced to rest on a letter of the alphabet space, the vocabulary word card corresponding to the letter printed in the space, in accordance with microeconomic market structure theory awarding the player a nonexclusive interest in the letter of the alphabet space as proclaimed on the vocabulary word card for a correct pronunciation and definition of the word by the player, and for incorrect response from the player assessing no penalty when the letter of the alphabet space is in a pure competition status, assessing a penalty when the letter of the alphabet space is in monopolistic competition status, and assessing a greater penalty when the letter of the alphabet space is in oligopoly status, drawing a question card when a player's assigned marker is advanced to rest on a space assigning a vocabulary related question, requiring the player to recite an answer to the vocabulary related question, for a correct answer to the vocabulary related question awarding the player a nonexclusive interest in the player's choice of any letter of the alphabet space as proclaimed on a corresponding vocabulary word card drawn and retained by the player, drawing an instruction for play card when a player's assigned marker is advanced to rest on a space marked by indicia assigning randomly selected instruction for play, requiring the player to accede to the randomly selected instruction for play and requiring a player to accede to instructions for play when the player's assigned marker is advanced to rest on a space containing indicia providing direct instructions for play, whereby a player acquiring nonexclusive interest in a letter of the alphabet space and in a predetermined group of letter of the alphabet spaces obtains advantage in further play, and a player first obtaining nonexclusive interest in all letter of the alphabet spaces on the game board wins the game.

10. The method of claim 9, wherein the penalty for incorrect pronunciation and definition of a vocabulary word comprises the step of withdrawing at least one nonexclusive interest in and the vocabulary word card corresponding to a letter of the alphabet space previously obtained by the player when the letter of the alphabet space on which the player's assigned marker rests is in monopolistic competition status, and the step of awarding a withdrawn nonexclusive interest and vocabulary word card to each opposing player who has previously acquired a nonexclusive interest in the letter of the alphabet space on which the player's marker rests.

11. The method of claim 9 wherein the greater penalty for incorrect pronunciation and definition of a vocabulary word comprises the steps of withdrawing at least two nonexclusive interests in and two vocabulary word cards corresponding to two letter of the alphabet spaces previously obtained by the player when the letter of the alphabet space on which the player's assigned marker rests is in oligopoly status and awarding two nonexclusive interests and corresponding word cards to each opposing player who has previously acquired a nonexclusive interest in the letter of the alphabet space on which the player's marker rests.

* * * * *